US005865614A

United States Patent [19]

Hsu

[11] Patent Number: 5,865,614

[45] Date of Patent: Feb. 2, 1999

[54] ELECTRONIC IGNITION GUN

[75] Inventor: Kun-Chung Hsu, Taoyuan Hsien, Taiwan

[73] Assignee: Huang-His Hsu, Taoyuan Hsien, Taiwan

[21] Appl. No.: 782,497

[22] Filed: Jan. 10, 1997

[51] Int. Cl.[6] ..... F23Q 7/12

[52] U.S. Cl. ..... 431/255; 431/256; 431/344; 126/229; 126/401; 126/405

[58] Field of Search ..... 431/255, 256, 431/265, 264, 128, 343–344, 153; 126/401–409, 413–414, 236–239, 226, 229

[56] References Cited

U.S. PATENT DOCUMENTS

| | | | |
|---|---|---|---|
| 4,536,983 | 8/1985 | Zeller et al. | 431/255 |
| 5,496,169 | 3/1996 | Chen | 431/255 |
| 5,771,880 | 6/1998 | Tsai | 431/255 |

FOREIGN PATENT DOCUMENTS

| | | | |
|---|---|---|---|
| 1435657 | 5/1976 | United Kingdom | 431/255 |

*Primary Examiner*—Carl D. Price
*Assistant Examiner*—Josiah Cocks
*Attorney, Agent, or Firm*—Jacobson, Price, Holman & Stern, PLLC

[57] ABSTRACT

An electronic ignition gun including a housing holding a gas lighter and a high voltage inductor, a press control switch pivoted to the housing and partially projecting out of an opening in the housing for operation with a hand to release the gas valve of the gas lighter and to trigger the high voltage inductor, the press control switch having a front projection adapted for triggering the high voltage inductor in inducing a high voltage for producing sparks for burning fuel gas, an arched rear side wall, and a bottom opening extended to a part of the arched rear side wall, and a gas lever balanced on a part of the gas lighter and having a notched coupling portion at one end coupled to the gas valve, an arched actuating face at an opposite end disposed in contact with the arched rear side wall of the press control switch, and a projecting block raised from one end of the arched actuating face and inserted into the bottom opening of the press control switch to guide the movement of the gas lever relative to the press control switch.

2 Claims, 3 Drawing Sheets

ELECTRONIC IGNITION GUN

BACKGROUND OF THE INVENTION

The present invention relates to electronic ignition guns, and more particularly to such an electronic ignition gun which produces little friction resistance when the press control switch is pressed, so that a stable flow of fuel gas can be released from a gas valve for burning.

Regular electronic ignition guns are commonly comprised of a press control switch for ignition control, and a gas lever for fuel gas release control. When the press control switch is pressed to ignite a fire, the gas lever is simultaneously pulled open, permitting fuel gas to be released from a gas lighter for burning. Because the press control switch is stopped against the gas lever, high friction resistance is produced when the press control switch is moved relative to the gas lever, therefore much effort shall be applied to the press control switch during the operation. Furthermore, when the press control switch is pressed, it tends to tilt toward one side, thereby causing fuel gas unable to be smoothly released from the gas lighter.

SUMMARY OF THE INVENTION

The present invention has been accomplished to provide an electronic ignition gun which eliminates the aforesaid drawbacks. According to one aspect of the present invention, the electronic ignition gun comprises a housing which holds a gas lighter and a high voltage inductor, a press control switch pivoted to the housing and partially projecting out of an opening in the housing for operation with a hand to release the gas valve of the gas lighter and to trigger the high voltage inductor, the press control switch having a front projection adapted for triggering the high voltage inductor in inducing a high voltage for producing sparks for burning fuel gas, and an arched rear side wall, and a gas lever balanced on a part of the gas lighter, the gas lever having a notched coupling portion at one end coupled to the gas valve, and an arched actuating face at an opposite end disposed in contact with the arched rear side wall of the press control switch. When the press control switch is pressed, the high voltage inductor is triggered by the front projection of the press control switch to release a high voltage through two electrodes for producing sparks for igniting fuel gas, and at the same time the gas lever is oscillated by the arched rear side wall of the press control switch to pull open the gas valve of the gas lighter in releasing fuel gas. According to another aspect of the present invention, the press control switch has a bottom opening extended to a part of the arched rear side wall; the gas lever has a projecting block raised from one end of the arched actuating face and inserted into the bottom opening of the press control switch to guide the movement of the gas lever relative to the press control switch. Therefore, the press control switch and the gas lever are moved relative to each other smoothly in course when the press control switch is pressed.

DETAILED DESCRIPTION OF THE PREFERRED EMBODIMENT

Figure 1:
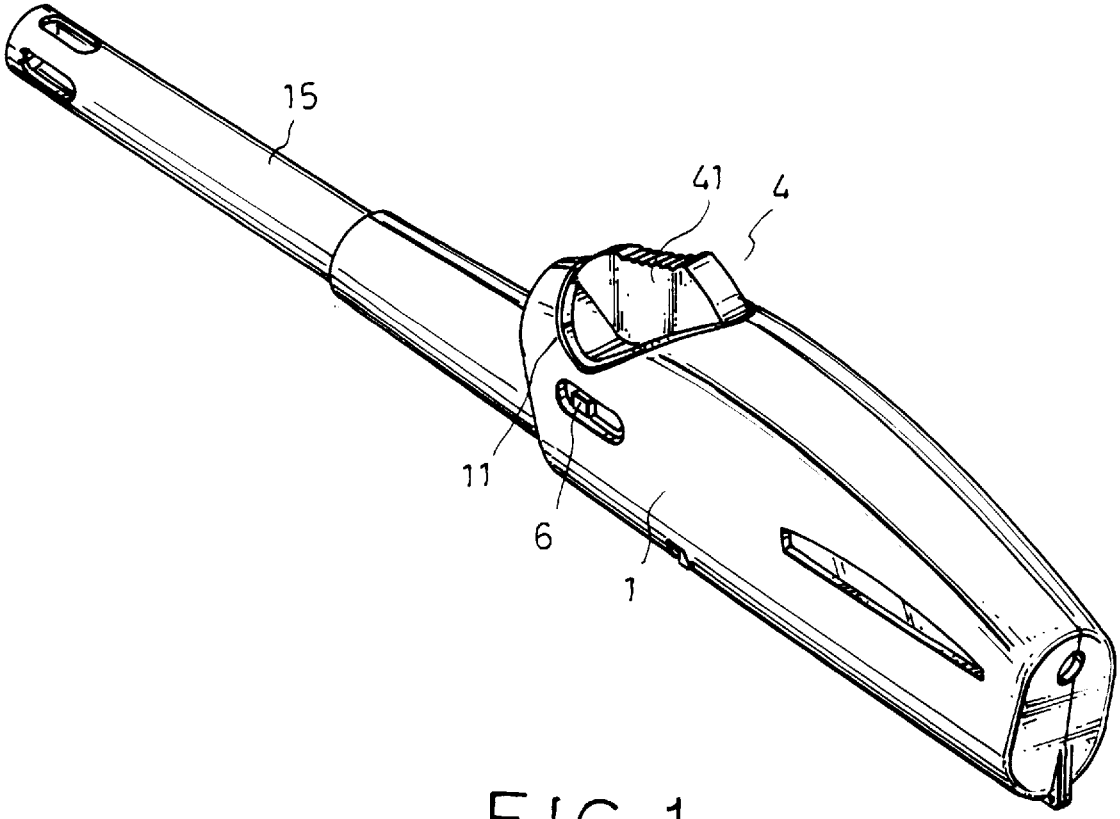
FIG. 1 is an elevational view of an electronic ignition gun according to the present invention.
Figure 2:
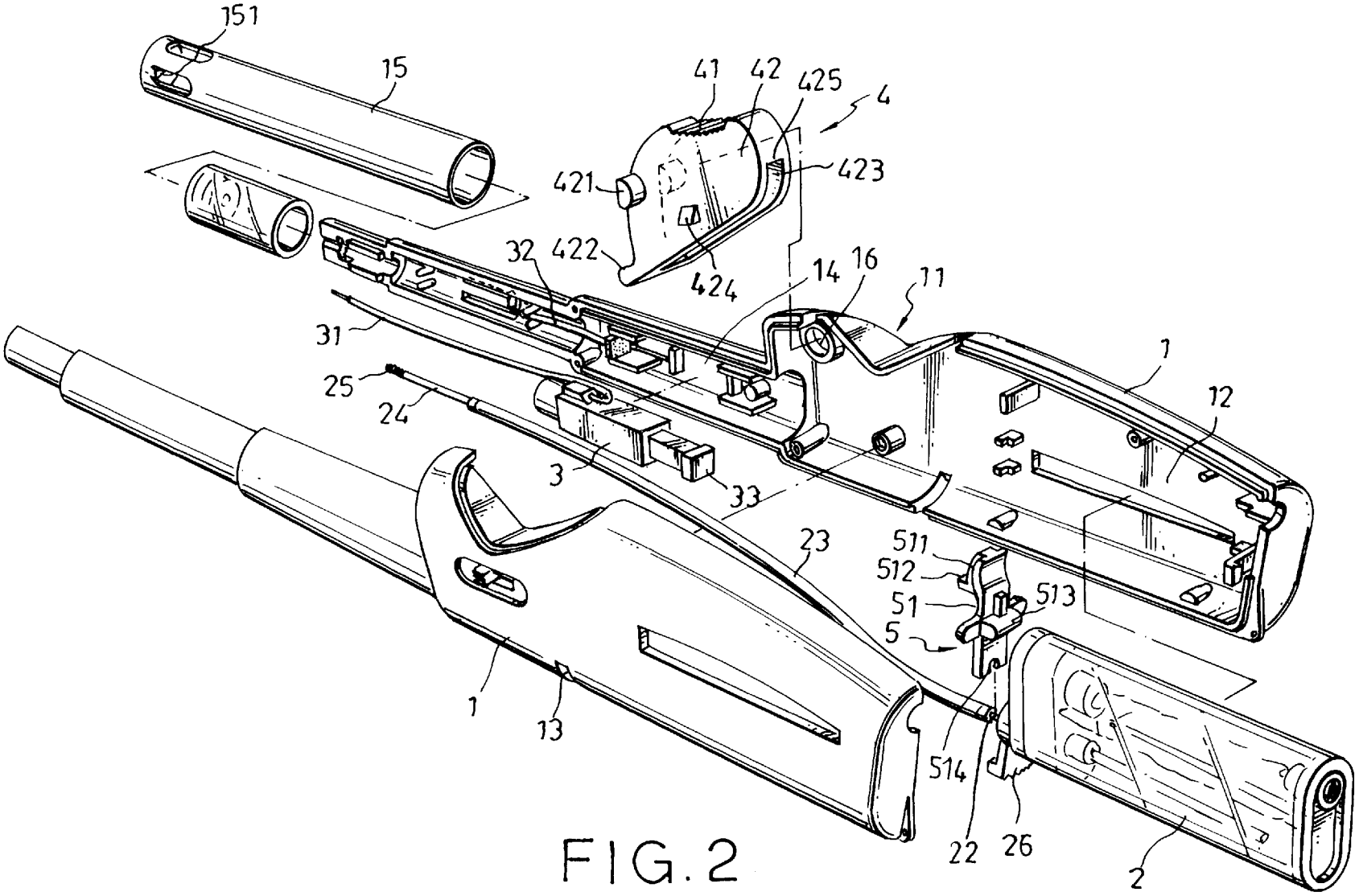
FIG. 2 is an exploded view of the electronic ignition gun shown in FIG. 1.
Figure 3:
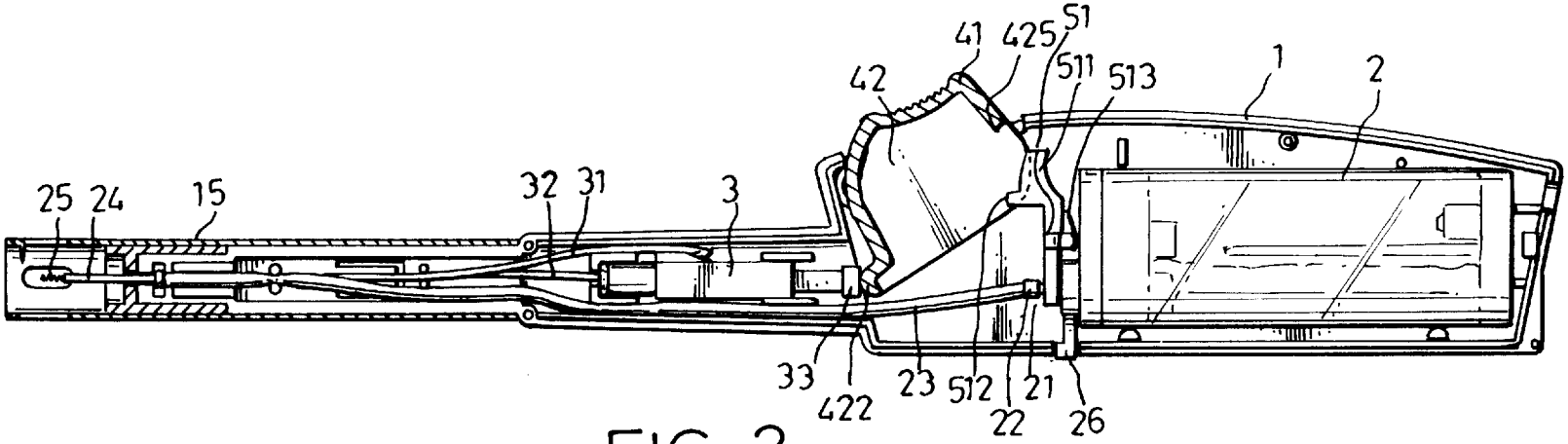
FIG. 3 is a side view in section of the electronic ignition gun shown in FIG. 1.

Referring to FIGS. 1, 2, and 3, an electronic ignition gun in accordance with the present invention comprises a housing 1 which is formed by connecting two symmetrical shells together. The housing 1 comprises an opening 11 at one side, a first receiving chamber 12 at the rear end, a second receiving chamber 14 in front of the first receiving chamber 12, and a hole 13 at one side opposite to the opening 11. A gas lighter 2 is loaded in the first receiving chamber 12, having a gas outlet 21, and a gas valve 22 mounted in the gas outlet 21 to control its passage. A flexible gas tube 23 is provided, having one end connected to the gas valve 22, and an opposite end extended into the second receiving chamber 14. A metal gas tube 24 is installed in the second receiving chamber 14, having one end connected to one end of the flexible gas tube 23 remote from the gas valve 22, and an opposite end coupled with a spring 25, which buffers the speed of the ejection of fuel gas from the gas lighter 2, for permitting fuel gas to be well mixed with air for complete combustion. The gas lighter 2 further comprises a flame adjustment lever 26 extended out of the hole 13 of the housing 1, and adapted for adjusting the flow rate of fuel gas. A high voltage inductor 3 is mounted within the second receiving chamber 14, having a first electrode 31 connected to a metal barrel 15, which is mounted around the front end of the housing 1, a second electrode 32 extended to a nearby area around the spring 25, and an actuating rod 33. A press control switch 4 is pivotably mounted in the housing 1, having a top side wall 41 extended out of the opening 14 of the housing 1 for operation, two symmetrical lateral side walls 42, two pivot pins 421 respectively and perpendicularly raised from the lateral side walls 42 and respectively turned in respective pivot holes 16 inside the housing 1, a front projection 422 stopped at the actuating rod 33 of the high voltage inductor 3, a stop rod 424 raised from one lateral side wall 42, an arched rear side wall 425 stopped against a gas lever 5, and a bottom opening 423 extended to a part of the arched rear side wall 425. The gas lever 5 comprises a lever body 51, a notched coupling portion 514 disposed at one end of the lever body 51 and coupled to the gas valve 22, an arched actuating face 511 stopped against the arched rear side wall 425 of the press control switch 4, a projecting block 512 raised from the arched actuating face 511 and inserted into the bottom opening 423, and a bearing portion 513 supported on a part of the gas lighter 2 for permitting the gas lever 5 to be oscillated. Furthermore, there is provided a sliding stop block 6 mounted in the housing 1, and moved relative to the stop rod 424 of the press control switch 4.

Figure 4:
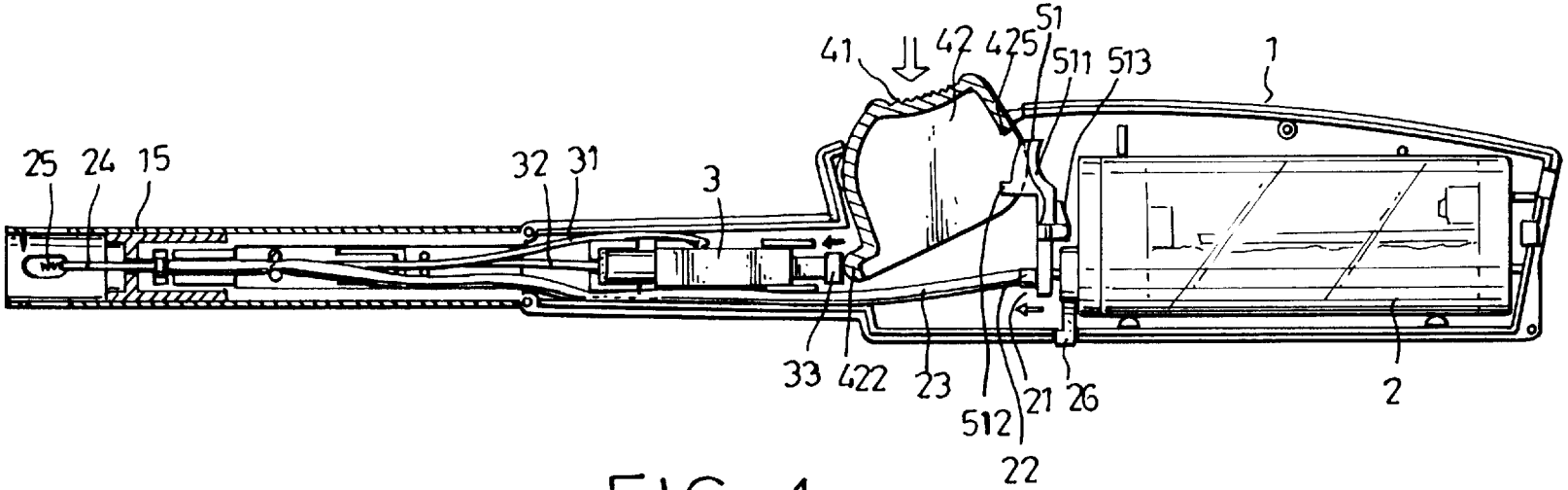
FIG. 4 is similar to FIG. 3 but showing the press control switch pressed.

Referring to FIGS. 3 and 4, when the top side wall 41 of the press control switch 4 is depressed, the press control switch 4 is turned about an axis, thereby causing the arched rear side wall 425 to be moved relative to the arched actuating face 511 of the gas lever 5. When the arched rear side wall 425 of the press control switch 4 is moved relative to the arched actuating face 511 of the gas lever 5, the lever body 51 is forced to oscillate, thereby causing the notched coupling portion 514 to pull the gas valve 22 outwards, for permitting fuel gas to be released from the gas lighter 2 through the flexible gas tube 23 and the metal gas tube 24 for burning. At the same time, the front projection 422 is forced to push the actuating rod 33 of the high voltage inductor 3 forwards, causing the high voltage inductor 3 to induce a high voltage through the electrodes 31, 32, and therefore sparks are produced between the front end 151 of the metal barrel 15 and the spring 25 (because the first electrode 31 is disposed near the spring 25, and the second electrode 32 is connected to the metal barrel 15), to burn fuel gas. Furthermore, when the sliding stop block 6 is pushed forwards, it is moved into engagement with the stop rod 424 of the press control switch 4 to lock the press control switch 4.

Because the arched rear side wall 425 of the press control switch 4 is disposed in contact with the arched actuating face 511 of the gas lever 5, friction resistance is minimized when the press control switch 4 is moved relative to the gas lever 5. Because the projecting block 512 of the gas lever 5 is inserted into the bottom opening 423 of the press control switch 4 and the bottom edges of the two lateral side walls 42 of the press control switch 4 are supported on the lever body 51 of the gas lever 5, the gas lever 5 can be stably oscillated.

While only one embodiment of the present invention has been shown and described, it will be understood that various modifications and changes could be made there unto without departing from the spirit and scope of the invention.

What the invention claimed is:

1. An electronic ignition gun comprising:

a housing holding a gas lighter and a high voltage inductor in front of said gas lighter and having an opening at one side in the middle and two pivot holes bilaterally disposed on the inside adjacent to said opening, said gas lighter comprising a gas valve for controlling output of fuel gas;

a press control switch pivoted to the pivot holes of said housing and partially projecting out of the opening of said housing for operation with a hand to open the gas valve of said gas lighter and to trigger said high voltage inductor, said press control switch comprising a top side wall extended out of the opening of said housing for operation, two symmetrical lateral side walls, two pivot pins respectively and perpendicularly raised from said lateral side walls and respectively turned in the pivot holes of said housing, a front projection adapted for triggering said high voltage inductor, an arched rear side wall, and a bottom opening extended to a part of said arched rear side wall; and a gas lever mounted inside said housing and driven by said press control switch to open the gas valve of said gas lighter, said gas lever comprising a bearing portion in the middle balanced on a part of said gas lighter, a notched coupling portion at one end coupled to said gas valve, an arched actuating face at an opposite end disposed in contact with the arched rear side wall of said press control switch, and a projecting block raised from one end of said arched actuating face and inserted into the bottom opening of said press control switch to guide the movement of said gas lever relative to said press control switch.

2. The electronic ignition gun of claim 1 wherein said press control switch comprises a stop rod raised from one lateral side wall; a sliding stop block is mounted in a hole in said housing and moved between a first position in which said sliding stop block is forced into engagement with the stop rod of said press control switch to lock said press control switch, and a second position in which said sliding stop block is disengaged from the stop rod of said press control switch to unlock said press control switch.

* * * * *